US011752772B2

(12) United States Patent
Atsuta et al.

(10) Patent No.: US 11,752,772 B2
(45) Date of Patent: Sep. 12, 2023

(54) INK CONTAINER AND INKJET PRINTER

(71) Applicant: CANON KABUSHIKI KAISHA, Tokyo (JP)

(72) Inventors: Tomohisa Atsuta, Tokyo (JP); Junichiro Iri, Kanagawa (JP); Yusuke Hashimoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 202 days.

(21) Appl. No.: 17/195,095

(22) Filed: Mar. 8, 2021

(65) Prior Publication Data

US 2021/0283917 A1 Sep. 16, 2021

(30) Foreign Application Priority Data

Mar. 13, 2020 (JP) ..... 2020-044447

(51) Int. Cl.
*B41J 2/175* (2006.01)

(52) U.S. Cl.
CPC ..... *B41J 2/175* (2013.01)

(58) Field of Classification Search
CPC ..... B41J 29/13; B41J 2/175; B41J 2/17509; B41J 2/17566; B41J 2002/17576
See application file for complete search history.

(56) References Cited

U.S. PATENT DOCUMENTS

| | | | | |
|---|---|---|---|---|
| 7,192,111 | B2 * | 3/2007 | Matsumoto | B41J 2/17513 347/7 |
| 9,724,929 | B2 * | 8/2017 | Yoshii | B41J 2/17553 |
| 2007/0052776 | A1 | 3/2007 | Guhse | |

FOREIGN PATENT DOCUMENTS

| | | | |
|---|---|---|---|
| CN | 1394750 | A | 2/2003 |
| CN | 1506223 | A | 6/2004 |
| CN | 2865687 | Y | 2/2007 |
| CN | 204382821 | U | 6/2015 |
| CN | 207449418 | U | 6/2018 |
| CN | 208264159 | U | 12/2018 |
| DE | 19935673 | A1 | 4/2001 |
| JP | 2016122353 | A | 7/2016 |
| JP | 2018-079585 | A | 5/2018 |

* cited by examiner

*Primary Examiner* — An H Do
(74) *Attorney, Agent, or Firm* — Canon U.S.A., Inc. I.P. Division

(57) ABSTRACT

There is provided an ink container for storing ink inside thereof. A replenishing opening refills the inside with ink. A moving member is disposed in the inside below the replenishing opening in the vertical direction. The moving member moves up and down in the vertical direction with a level of a liquid surface of the ink, stored inside, which moves up and down in the vertical direction.

20 Claims, 7 Drawing Sheets

INK CONTAINER AND INKJET PRINTER

BACKGROUND

Field of the Disclosure

The present disclosure relates to an ink container and an inkjet printer.

Description of the Related Art

Inkjet printers, which eject ink for recording, include an ink container to store ink. As recording progresses, the ink is consumed. If the remaining amount of ink is insufficient, a user may need to refill the ink container with ink by themselves.

SUMMARY

According to one embodiment of the present disclosure, there is provided an ink container for storing ink inside thereof, comprising a replenishing opening for refilling the inside with ink; and a moving member disposed in the inside below the replenishing opening in the vertical direction, wherein the moving member moves up and down in the vertical direction with a level of a liquid surface of the ink, stored inside, which moves up and down in the vertical direction.

According to another embodiment of the present disclosure, there is provided an inkjet printer comprising an inkjet head configured to eject ink; and an ink container configured to store the ink inside thereof, wherein the ink container has a replenishing opening for refilling the inside thereof with ink, and wherein a moving member is disposed in the inside of the ink container at a position below the replenishing opening in the vertical direction, and the moving member moves up and down in the vertical direction with a level of a liquid surface of ink, stored inside, which moves up and down in the vertical direction.

Further features of the present disclosure will become apparent from the following description of exemplary embodiments with reference to the attached drawings.

DESCRIPTION OF THE EMBODIMENTS

When an ink container is refilled from an ink bottle that contains refill ink, the refill ink may collide with the liquid surface of ink already stored in the ink container, causing the ink to bubble or splash (bounce back). For example, if the ink splashes, it may adhere to the injection port of the ink bottle and contaminate the ink bottle.

Figure 9A:
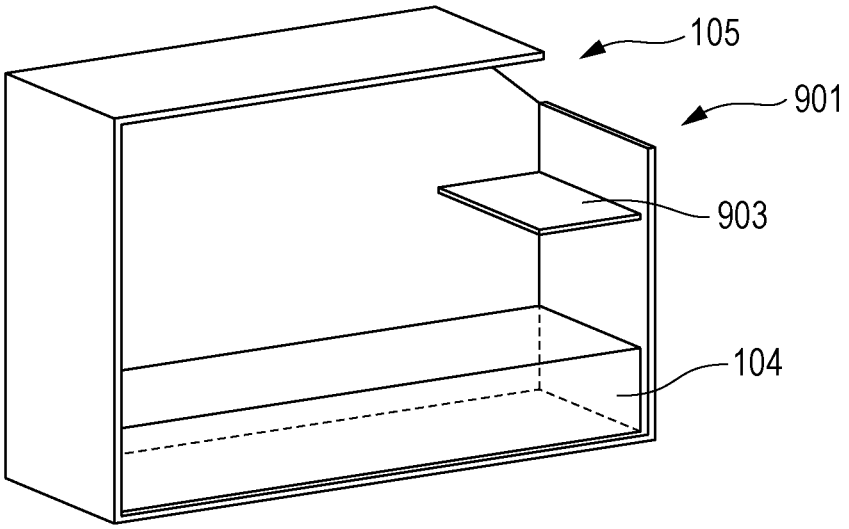
FIG. 9A is a perspective view of an existing ink container.
Figure 9B:
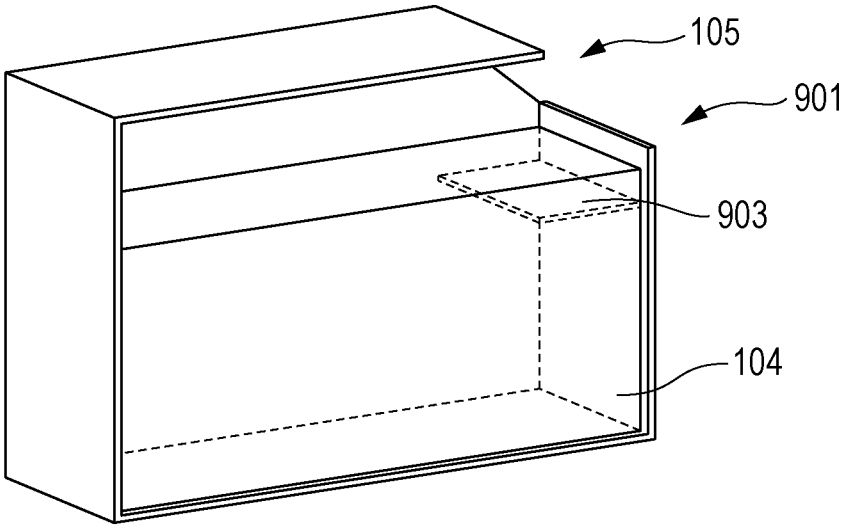
FIG. 9B is a perspective view of an existing ink container.

The ink container described in Japanese Patent Laid-Open No. 2018-79585 is illustrated in FIGS. 9A and 9B. According to Japanese Patent Laid-Open No. 2018-79585, as illustrated in FIG. 9A, a shielding plate 903 is disposed inside an ink container 901 to prevent the refill ink from directly colliding with the liquid surface of ink in the ink container.

However, in the configuration described in Japanese Patent Laid-Open No. 2018-79585, as illustrated in FIG. 9B, the shielding plate 903 may be submerged in the ink when the amount of ink in the ink container is large. If the shielding plate 903 is submerged in the ink, the refill ink directly collides with the ink, which may cause the ink to bubble or splash.

An embodiment of the present disclosure provides an ink container capable of preventing refill ink from directly colliding with the ink in the ink container, regardless of the amount of ink in the ink container.

The embodiment of the present disclosure is described in detail below. Note that the following description is provided with reference to an example of an inkjet printer that ejects ink for recording, such as printing. However, the present disclosure is not limited thereto. That is, because the present disclosure can be applied to any container that can be refilled as needed, such as a container that can be refilled with paint, the scope of the present disclosure is applied to such a container. However, in inkjet printers, if refill ink bubbles up due to direct collision with the ink in the ink container, fine bubbles dissolve in the ink and cause ejection defects. That is, ink in inkjet printers is more susceptible to direct collision between inks than something like paint. For this reason, the present disclosure can be applied more suitably to ink used for inkjet printers.

Inkjet Printer

Figure 1:
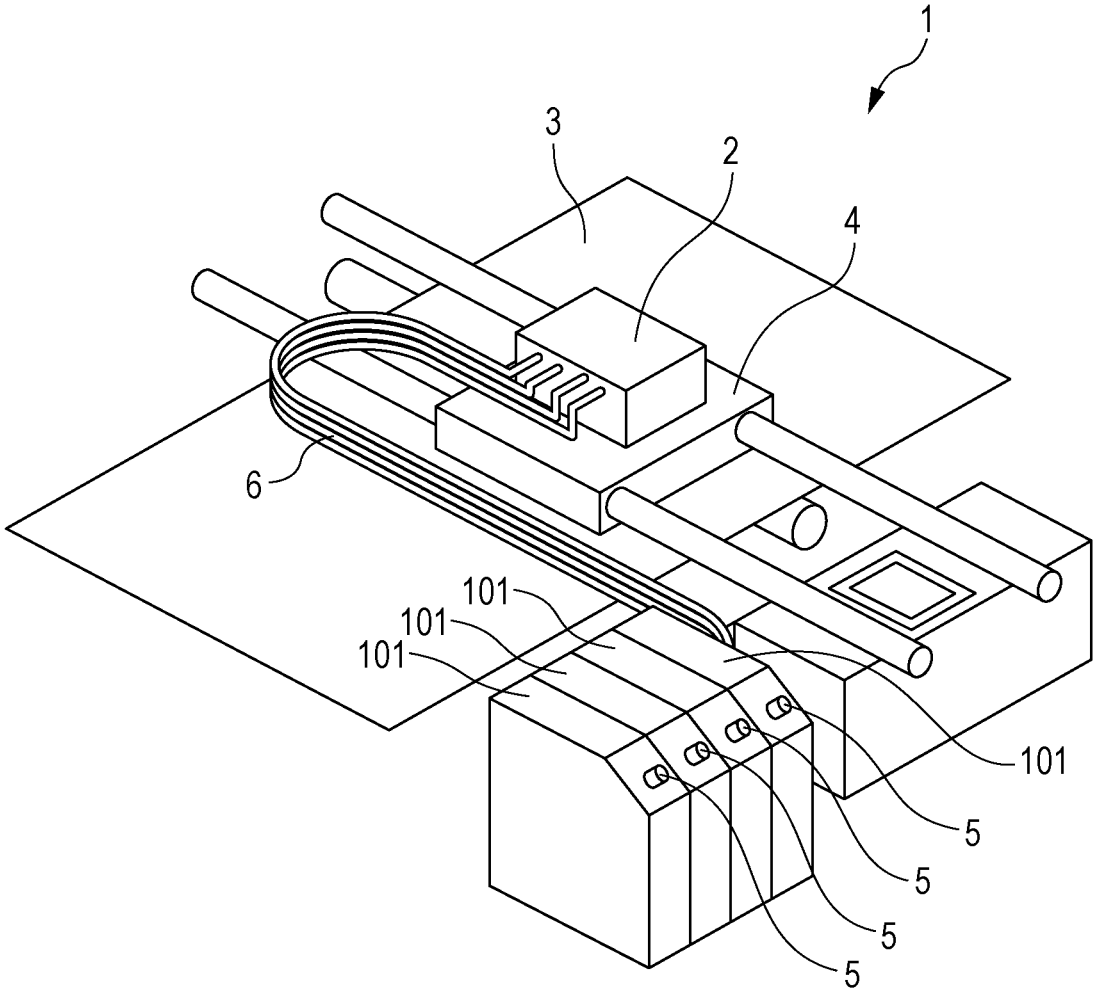
FIG. 1 is a diagram illustrating an inkjet printer.

An inkjet printer is described below with reference to FIG. 1. FIG. 1 is a schematic illustration of an inkjet printer 1. The inkjet printer 1 performs recording by repeating reciprocal movement of an inkjet print head 2 (main scanning) and conveyance of a recording sheet 3, which is a recording medium such as paper, at a predetermined pitch (sub-scanning) and ejecting ink from the inkjet print head 2 in synchronization with these movements. The inkjet print head 2 is removably mounted on a carriage 4 that is installed on two guide rails in a slidable manner.

The inkjet printer 1 includes an ink container 101 that can store ink to be ejected from the inkjet print head 2. The ink container 101 according to the present embodiment is designed to have a larger capacity than existing widely used replaceable ink containers. When the ink contained in the ink container 101 is completely consumed (insufficient), the user first removes a cap 5 attached to a replenishing opening 105 (FIG. 2) of the ink container 101. Subsequently, the user loads (refills), into the inside of the ink container 101, ink in an ink bottle filled with refill ink through the replenishing opening 105. After refilling of ink is completed, the cap 5 is reattached to the replenishing opening 105, and the series of ink refilling operations is completed. The ink container 101 and the inkjet print head 2 are connected to each other via an ink supply tube 6, and the ink in the ink container 101 is supplied to the inkjet print head 2 via the ink supply tube 6.

Ink Container

Figure 2:
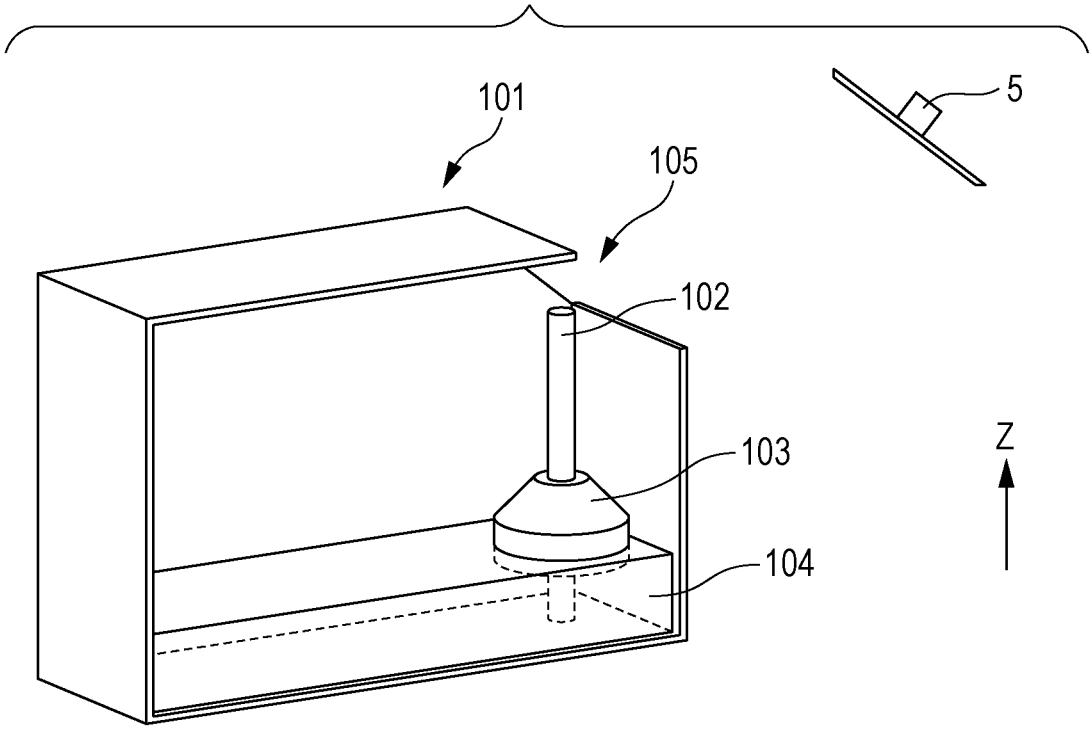
FIG. 2 is a perspective view of an ink container according to a first embodiment.

The ink container 101 is described below with reference to FIG. 2. FIG. 2 is a schematic illustration of the ink container 101. For ease of description, the cap 5 is removed so that the inside of the ink container can be seen. The ink container 101 mainly consists of a pillar 102, a moving member 103, and the replenishing opening 105. The moving member 103 has a through-hole 304 (FIGS. 3A and 3B) formed at the center portion thereof. The through-hole 304 has a diameter larger than that of the pillar 102. The pillar 102 is inserted into the through-hole 304. The pillar 102 extends from the bottom of the ink container 101 toward the replenishing opening 105. By passing the pillar 102 through the through-hole 304, the moving member 103 can be moved up and down in the vertical direction (the Z direction) while preventing the moving member 103 from moving freely in the ink container 101. In addition, by passing the pillar 102 through the through-hole 304, the moving member 103 can be disposed so as to be located directly beneath the replenishing opening 105 at all times. While a single circular cylinder is illustrated in FIG. 2 as the pillar 102, the shape of the pillar 102 is not limited to any particular shape as long as the shape enables the moving member 103 to move up and down.

Moving Member

Figure 3A:
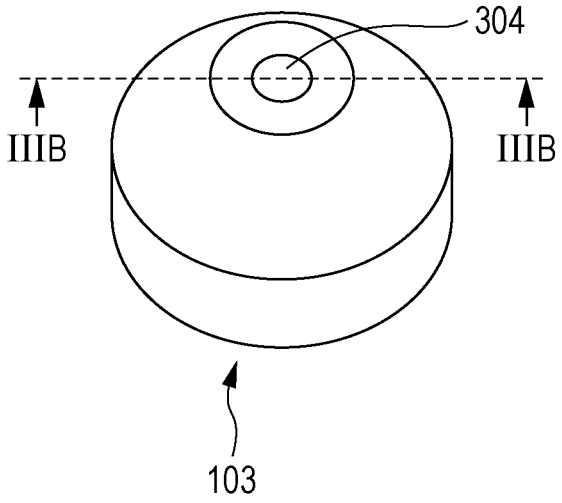
FIG. 3A is a perspective view of a moving member according to the first embodiment.
Figure 3B:
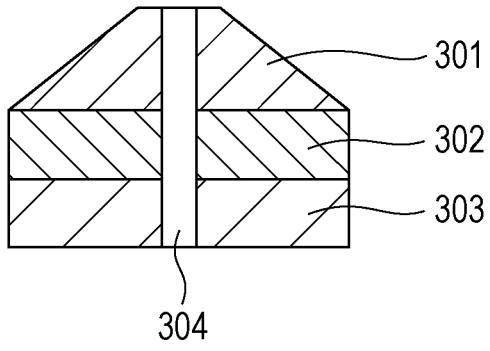
FIG. 3B is a cross-sectional view of the moving member taken along line IIIB-IIIB of FIG. 3A.

The moving member 103 is described below with reference to FIGS. 3A and 3B. FIG. 3A is a perspective view of the moving member 103. FIG. 3B is a cross-sectional view of the moving member 103 taken along line IIIB-IIIB of FIG. 3A. As illustrated in FIGS. 3A and 3B, the moving member 103 has a shape that is a combination of a cone and a circular cylinder, and the through-hole 304 having a diameter larger than that of the pillar 102 is formed in the center portion of each of the cone and the circular cylinder.

The moving member 103 has a plurality (three) of layers, that is, an upper layer 301, an intermediate layer 302, and a lower layer 303. The upper layer 301 is a member with which the refill ink collides first. Accordingly, it is desirable that the upper layer 301 have a structure capable of preventing the splash of the ink and the like. For this reason, it is desirable that the upper layer 301 have a low density and has an air space formed in the area including the top surface of the upper layer 301. The formed air space allows part of the refill ink to pass therethrough and prevents the ink from splashing (bouncing back), etc. For example, it is desirable that the upper layer 301 be an aggregate of polypropylene fibers.

It is desirable that the intermediate layer 302 have a density higher than the upper layer 301. For example, it is desirable that the intermediate layer 302 be an aggregate of polypropylene fibers that has a higher density (that is more dense) than the upper layer 301. This is because if the intermediate layer 302 has a density lower than the upper layer 301, the center of gravity of the moving member 103 is at a higher position and, thus, the moving member 103 may shake up and down significantly due to the impact of ink during refilling. If the moving member 103 shakes up and down significantly, the liquid surface of the ink also shakes up and down. As a result, the ink may fly out of the ink container 101 through the replenishing opening 105. However, by setting the center of gravity of the moving member 103 at a low position, the shaking of the moving member 103 in the vertical direction can be reduced.

The lower layer 303 is a part that is in contact with the liquid surface of the ink. To move the moving member 103 up and down with the level of the liquid surface of the ink and, thus, prevent the moving member 103 from submerging under the ink, it is desirable that the lower layer 303 have high buoyancy. Similarly, to keep the center of gravity of the moving member 103 at a low position and, thus, prevent shaking of the moving member 103, it is desirable that the lower layer 303 has a density higher than the upper layer 301 and the intermediate layer 302. For example, a material including urethane foam can be suitably used as the lower layer 303. To ensure more reliable contact with the refilled ink, it is desirable that the moving member 103 has such a configuration so as to be positioned facing the replenishing opening 105. That is, when a virtual plane including the replenishing opening 105 is placed, it is desirable that the moving member 103 be disposed so as to overlap a perpendicular line of the virtual plane.

Note that if the moving member 103 has buoyancy that prevents it from submerging in the ink and prevents ink from splashing, the moving member 103 need not have the three-layer structure illustrated in FIG. 3B. For example, the moving member 103 may have a two-layer structure with only an upper layer and a lower layer. In the case of a two-layer structure, for example, the lower layer 303 illustrated in FIG. 3B can be used as the vertically lower layer, and the upper layer 301 or the intermediate layer 302 can be used as the vertically upper layer. Note that even the combination of the intermediate layer 302 and the upper layer 301 illustrated in FIG. 3B can provide the effect of preventing splashing of the ink. However, in this case, the buoyancy is less than that of a moving member consisting of the lower layer 303 and the upper layer 301. As a result, if the amount of ink to be refilled per unit time is large, the movement of the moving member in the vertical upward direction may be delayed with respect to the increase rate of the amount of refilled ink. Thus, the moving member 103 may submerge in the ink. For this reason, when a two-layer structure is employed for the moving member, it is desirable that a two-layer structure of the lower layer 303 and the upper layer 301 illustrated in FIG. 3B or a two-layer structure of the lower layer 303 and the intermediate layer 302 illustrated in FIG. 3B be employed. That is, the density of the upper layer in the two-layer structure is lower than that of the lower layer. In addition, to prevent the vertical shaking of the moving member, it is desirable that the buoyancy of at least the lower layer be higher than that of the upper layer.

Furthermore, the moving member 103 may have a single layer structure instead of having a multilayer structure. However, for example, if the single-layer moving member 103 consists of the upper layer 301, the buoyancy of the moving member 103 is low and, thus, if the amount of ink to be refilled per unit time is large, the moving member 103 may submerge in the refilled ink. As a result, the refill ink delivered from the replenishing opening 105 directly contacts the ink surface, which may result in splashing of the ink. Alternatively, if the single-layer moving member 103 consists of the lower layer 303, the refill ink collides with a part having a high density, which reduces the effect of preventing splashing of the ink. For this reason, it is desirable that the moving member 103 have such a structure that the upper portion is coarse (has a low density) and the moving member 103 becomes finer (has a higher density) toward the lower portion. That is, it is desirable that the density of the moving member 103 decrease from the upper layer toward the lower layer. Note that when the moving member 103 consists of a single layer, it is desirable that the urethane foam be employed for the lower layer 303 illustrated in FIG. 3B, from the viewpoint of buoyancy. However, as described above, since a dense urethane foam has a small effect in preventing splashing of the ink, it is desirable that the urethane foam have minute recesses (air spaces) formed therein to increase the effect of preventing splashing of the ink. In this way, part of the refilled ink passes through the air spaces, and the effect of preventing splashing (bounceback) of the ink can remain persistently high.

Figure 4A:
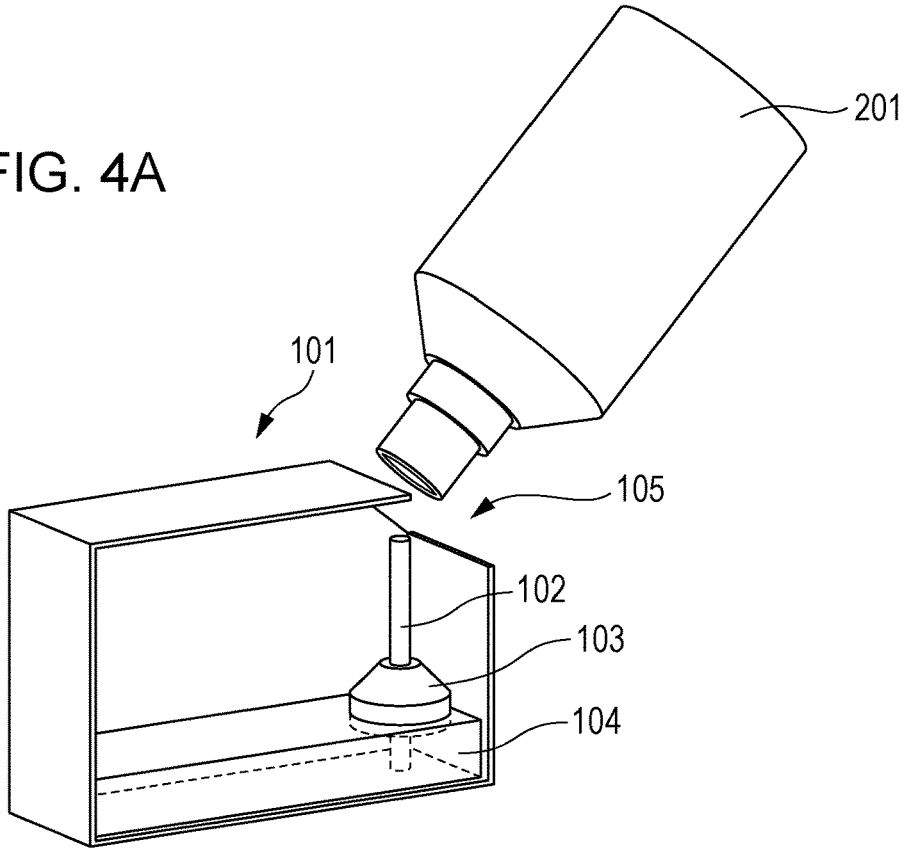
FIG. 4A illustrates the ink container being refilled with ink.
Figure 4B:
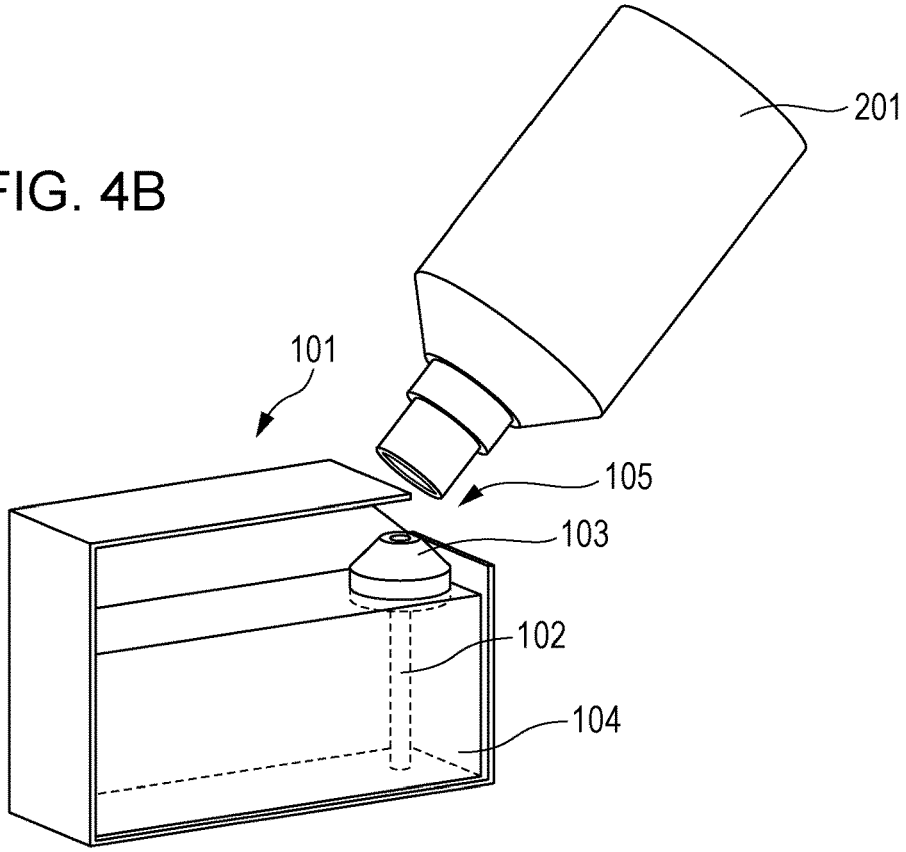
FIG. 4B illustrates the ink container being refilled with ink.

FIGS. 4A and 4B illustrate the ink container 101 that is being refilled with ink. FIG. 4A illustrates the ink container 101 in an initial stage of ink refilling work. FIG. 4B illustrates the ink container 101 when the ink refilling work is completed. When the ink container 101 in the initial stage illustrated in FIG. 4A is refilled with ink, the liquid surface of ink 104 in the ink container 101 rises vertically upward, and the moving member 103 moves upward along the pillar 102. The moving member 103 has a region exposed from the liquid surface of the ink at all times. As a result, the refill ink collides with the top surface of the moving member 103, regardless of the level of the liquid surface of the ink. Therefore, the splash (scattering) of the ink can be prevented, regardless of the level of the liquid surface of the ink.

While the above description has been given with regard to the moving member 103 having a shape of a combination of a cone and a circular cylinder, the present disclosure is not limited thereto. That is, the shape may be a combination of one of a triangular pyramid and quadrangular pyramid and a rectangular cylinder, for example. In addition, the shape of the portion that constitutes the top surface of the moving member 103 with which refill ink collides is not limited to a shape having a slope. For example, the shape may be a rectangular cylinder or circular cylinder. Furthermore, the lower layer 303 (the lowermost layer) having high buoyancy may be a member including a resin plate or an air chamber.

Furthermore, even if a foreign matter is included in the ink, the effect of trapping the foreign matter can be provided by using an aggregate of compressed polypropylene fibers as the upper layer 301 and intermediate layer 302.

Second Embodiment

Figure 5A:
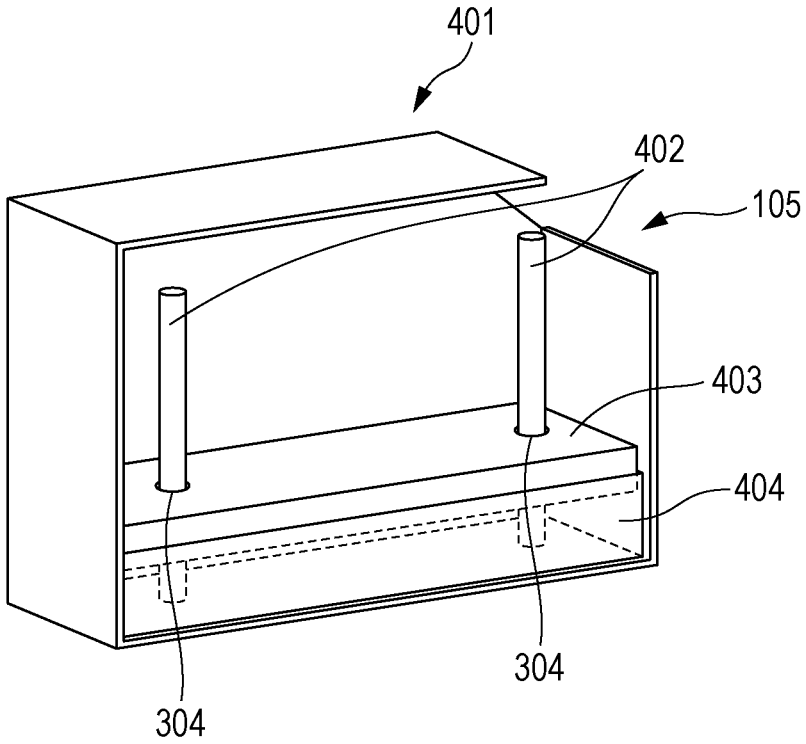
FIG. 5A is a perspective view of an ink container according to a second embodiment.

The second embodiment is described below with reference to FIGS. 5A through 5C. The same reference numerals are used in FIGS. 5A through 5C for elements that are the same or similar to those elements described in the first embodiment, and description of the elements is not repeated. According to the present embodiment, in addition to preventing splashing of the ink, evaporation of the ink can be prevented. An ink container 401 mainly consists of pillars 402, a moving member 403, and the replenishing opening 105. By providing a moving member 403 having an area that can widely cover the bottom surface of the ink container 401, the range where the ink is in contact with the air can be reduced. This prevents evaporation of the ink. More specifically, it is desirable that the moving member 403 covers 80 percent of the bottom surface of the ink container 401. Suppose that the moving member 403 covers nearly 100 percent of the bottom surface of the ink container 401. Then, there is almost no gap between the moving member 403 and the side wall of the ink container 401.

Consequently, the moving member 403 and the side wall of the ink container 401 rub against each other, and the movement of the moving member 403 up and down in the vertical direction is inhibited. For this reason, it is desirable that the size of the moving member 403 according to the present embodiment be large enough to cover 80 percent of the area of the base of the ink container 401.

Note that since the moving member 403 extends over the entire surface of the ink container 101, the refilled ink may remain on the moving member 403. Thus, it may take time for the refill ink to flow downward. At this time, if refill ink is continuously suppled and if the amount of refill ink is greater than the amount of ink that falls below the moving member 103, the moving member 103 is submerged in ink. As a result, subsequently supplied refill ink may come into direct contact with the liquid surface, resulting in splashing of the ink.

Figure 5B:
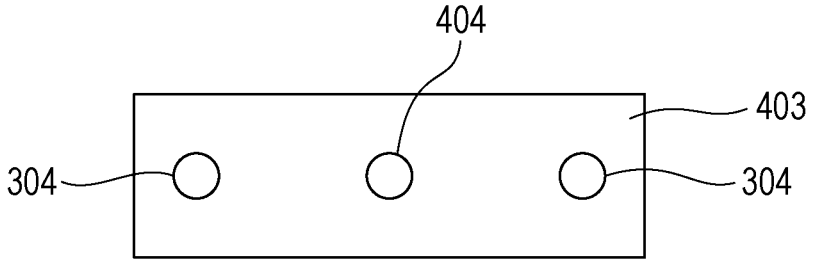
FIG. 5B is a top view of a moving member according to the second embodiment.
Figure 5C:
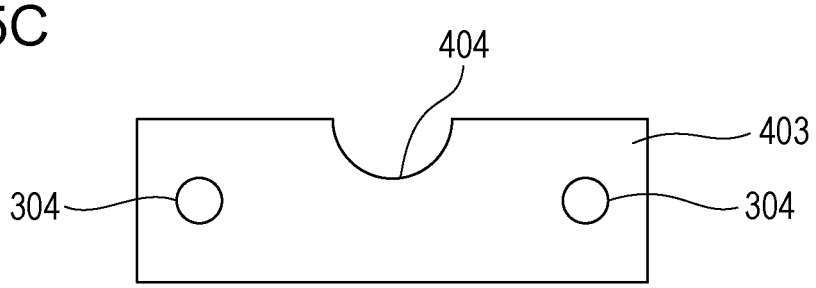
FIG. 5C is a top view of a moving member according to the second embodiment.

Accordingly, to cause the ink to flow downward, it is desirable that an ink flow portion 404 be provided in part of the moving member 403 so that the ink rapidly flows downward below the moving member, as illustrated in FIG. 5B. This allows the refill ink to move below the moving member 403 via the ink flow portion 404. Thus, the moving member 403 is prevented from being submerged in ink. In FIG. 5B, a through-hole that penetrates the moving member 403 is formed as the ink flow portion 404. However, since ink tends to evaporate through the ink flow portion 404, it is desirable that the through-hole be formed only in the lower layer of the moving member 403 if the moving member 403 has a multilayer structure. By providing the ink flow portion 404 only in the lower layer, the upper layer is present above the through-hole, and it is possible to prevent the liquid surface of the ink from being directly exposed to the air. That is, by providing the ink flow portion 404 only in the lower layer, it is possible to prevent the moving member 403 from being submerged in the ink while preventing the evaporation of the ink. Note that the ink flow portion 404 does not necessarily have to have the shape of a hole, but may have, for example, the shape of a notch formed at the edge of the moving member 403, as illustrated in FIG. 5C. Even if the ink flow portion 404 is a notch, the same effect can be obtained.

Third Embodiment

The third embodiment is described below with reference to FIG. 6. The same reference numerals are used in FIG. 6 for elements that are the same or similar to those elements described in the first embodiment, and description of the elements is not repeated. An ink container 601 mainly consists of a pillar 602, a moving member 103, and the replenishing opening 105. According to the present embodiment, to prevent more splashing of the ink, the movement direction of the moving member 103 is set to be on the trajectory followed by the ink at the time of refilling the ink. More specifically, when a virtual plane including the replenishing opening 105 is placed, it is desirable that the moving member 103 be disposed at a position that overlaps a perpendicular line of the virtual plane even if the moving member 103 moves with the rise of the liquid surface of the ink. This allows the refill ink to collide with the moving member 103 more reliably, and more splashing of the ink is prevented.

Figure 6:
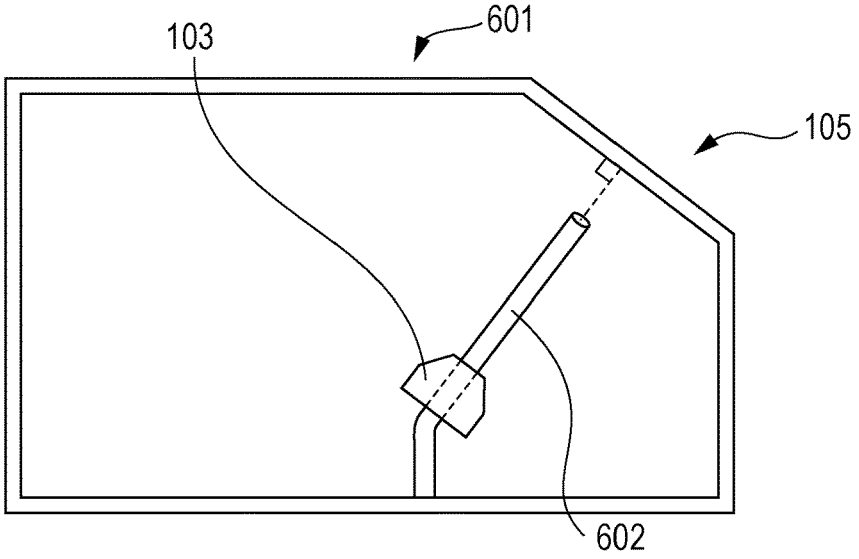
FIG. 6 is a perspective view of an ink container according to a third embodiment.

As illustrated in FIG. 6, when the replenishing opening 105 of the ink container 101 is provided at an angle to the vertical direction, the injection port of the ink bottle 201 connected to the replenishing opening 105 is also at an angle to the vertical direction. As a result, when the refill ink is supplied to the ink container 101, the ink injected from the injection port of the ink bottle is also injected at an angle to the vertical direction and is loaded into the ink container 101. Accordingly, in the case where the moving member 103 moves in the same direction as the vertical direction, even if the ink collides with the moving member 103 in the initial stage of ink refilling work, the ink may no longer collide with the moving member 103 when the moving member moves in the vertical upward direction with the rise of the liquid surface of the ink. Therefore, according to the present embodiment, since the moving member 103 moves in the direction of the trajectory followed by the ink, the ink can be made to collide with the moving member 103 in the initial stage to the final stage of ink refilling work, and splashing of the ink can be prevented.

To make the movement direction of the moving member 103 be the trajectory followed by the ink, a pillar 602 is inclined with respect to the vertical direction so as to extend in the direction of the ink trajectory. That is, when a virtual plane including the replenishing opening 105 is placed, the pillar 602 is inclined so as to extend in the direction of the perpendicular line of the virtual plane. Note that the direction of the trajectory followed by the ink is the direction in which the replenishing opening 105 faces (the direction of the perpendicular line of the virtual plane including the replenishing opening 105).

Fourth Embodiment

Figure 7:
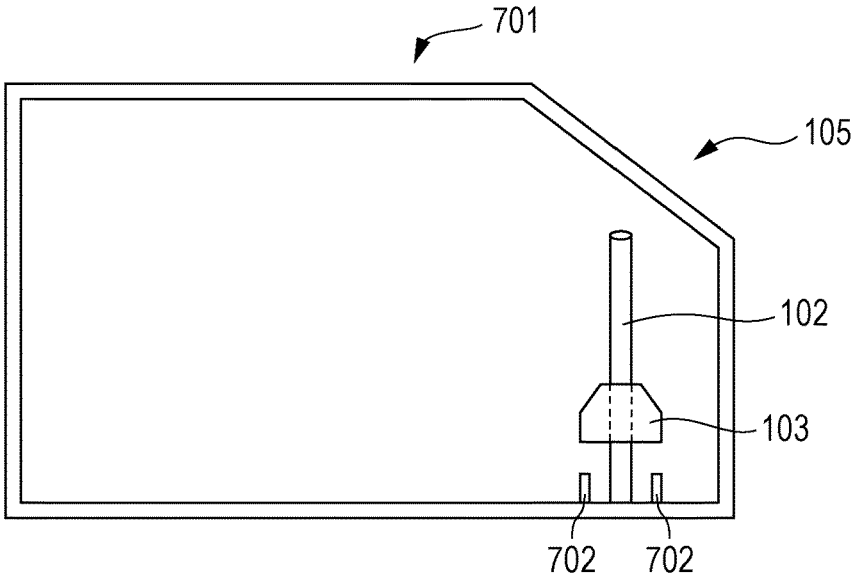
FIG. 7 is a perspective view of an ink container according to a fourth embodiment.

The fourth embodiment is described below with reference to FIG. 7. The same reference numerals are used in FIG. 7 for elements that are the same or similar to those elements described in the first embodiment, and description of the elements is not repeated. When the ink in the ink container 701 is completely consumed, the bottom surface of the moving member 103 is in contact with the bottom surface of the ink container 701. Accordingly, in some cases, the bottom surface of the moving member 103 and the bottom surface of the ink container 701 may adhere to each other due to the adherence of the ink. As a result, when, thereafter, the refill ink is supplied and the liquid surface of the ink rises, the moving member 103 may not separate from the bottom surface of the ink container 101, and the moving member 103 may not move up and down in the vertical direction with the level of the liquid surface of the ink.

Therefore, according to the present embodiment, a protrusion 702 is provided on the bottom surface of the ink container 701 so that the moving member 103 is in contact with the protrusion 702 when the ink in the ink container 701 is completely consumed. This prevents the bottom surface of the moving member 103 from being in direct contact with the bottom surface of the ink container 701.

The area of the protrusion 702 is much smaller than the area of the base of the moving member 103. More specifically, the area of the base of the protrusion 702 is less than or equal to one-tenth of the area of the base of the moving member 103. For this reason, even if the protrusion 702 and the moving member 103 adhere to each other due to the adhesion of ink, the adhesion strength is significantly small. Therefore, the buoyancy of the moving member 103 obtained when the refill ink is supplied and the liquid surface of the ink rises causes the protrusion 702 and the moving member 103 to separate from each other against the adhesion strength. Thus, the moving member 103 can move with the level of the liquid surface of the ink. Note that the protrusion 702 may be provided on the bottom surface of the moving member 103. Even in this case, the same effect can be obtained.

Fifth Embodiment

Figure 8:
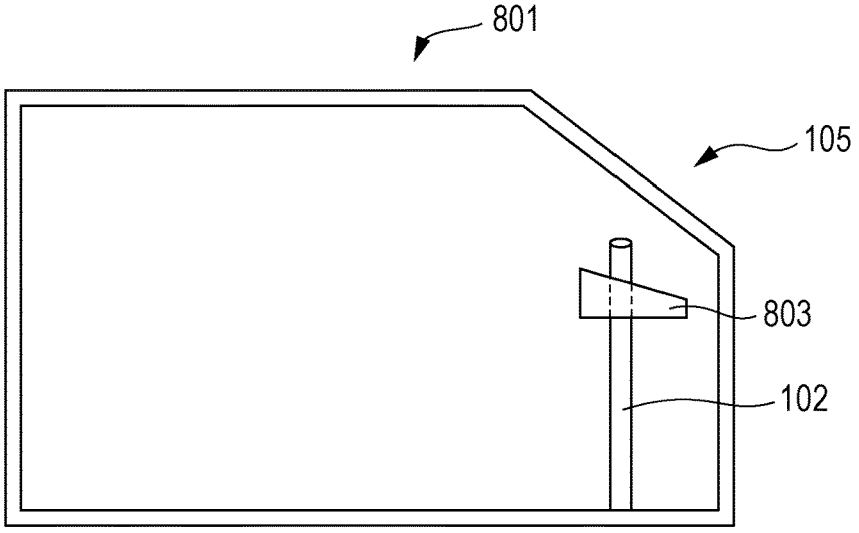
FIG. 8 is a perspective view of an ink container according to a fifth embodiment.

The fifth embodiment is described with reference to FIG. 8. The same reference numerals are used in FIG. 8 for elements that are the same or similar to those elements described in the first embodiment, and description of the elements is not repeated. An ink container 801 mainly consists of a pillar 102, a moving member 803, and the replenishing opening 105. According to the present embodiment, the shape of a moving member 803 is determined so as to follow the inclination of the replenishing opening 105 of the ink container to the vertical direction. More specifically, the inclination angle of the upper surface of the moving member 803 to the vertical direction is determined so as to be substantially the same as the inclination angle of a virtual plane including the replenishing opening 105 to the vertical direction. As used herein, the term "substantially the same" means that the difference between the inclination angle of the top surface of the moving member and the inclination angle of the virtual plane including the replenishing opening 105 is within 10 degrees. This prevents part of the moving member 803 from protruding from the replenishing opening 105 even if the moving member moves to the vicinity of the replenishing opening 105 with the rise of the liquid surface of the ink.

If the moving member does not have a shape that follows the inclination of the replenishing opening 105 to the vertical direction, part of the moving member 803 may protrude from the replenishing opening 105 when the moving member moves to the vicinity of the replenishing opening 105 with the rise of the liquid surface of the ink. At this time, if the refill ink is continuously supplied, the ink may splash outside. Therefore, according to the present embodiment, the shape of the moving member 803 is determined to follow the inclination of the replenishing opening 105 of an ink container 900. As a result, even if the moving member 803 rises in the upward direction with the rise of the liquid surface of the ink, part of the moving member 803 can be prevented from protruding from the replenishing opening 105, and the ink can be prevented from splashing outside.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-044447, filed Mar. 13, 2020, which is hereby incorporated by reference herein in its entirety.

What is claimed is:

1. An ink container for storing ink inside thereof, comprising:

a replenishing opening for refilling the inside with ink;

a pillar provided in the inside of the ink container and extending from a bottom surface of the ink container toward the replenishing opening; and a moving member disposed in the inside, on the pillar, below the replenishing opening in the vertical direction, wherein the moving member moves up and down the pillar with a level of a liquid surface of the ink, stored inside, which moves up and down in the vertical direction.

2. The ink container according to claim 1, wherein an air space is formed in a portion of a top surface of the moving member in the vertical direction.

3. The ink container according to claim 2, wherein the portion including the top surface of the moving member in the vertical direction is an aggregate of polypropylene fibers.

4. The ink container according to claim 1, wherein the moving member is disposed at a position that overlaps a perpendicular line of a plane including the replenishing opening.

5. The ink container according to claim 1, wherein the moving member has a through-hole formed therein, and wherein the pillar is inserted into the through-hole.

6. The ink container according to claim 1, wherein a portion of the moving member in contact with the ink is urethane foam.

7. The ink container according to claim 1, wherein the moving member has a two-layer structure of an upper layer and a lower layer.

8. The ink container according to claim 7, wherein a density of the upper layer is lower than a density of the lower layer.

9. The ink container according to claim 7, wherein a buoyance of the lower layer is greater than that of the upper layer.

10. The ink container according to claim 7, wherein the upper layer is an aggregate of polypropylene fibers, and the lower layer is urethane foam.

11. The ink container according to claim 1, wherein the moving member has an upper layer, an intermediate layer, and a lower layer, and a density of the moving member increases from the upper layer toward the lower layer.

12. The ink container according to claim 1, wherein the moving member covers 80 percent of a bottom surface of the ink container.

13. The ink container according to claim 12, wherein the moving member has an ink flow portion formed therein, and refill ink flows through the ink flow portion.

14. The ink container according to claim 1, wherein the pillar is inclined to the vertical direction.

15. The ink container according to claim 1, wherein a bottom surface of the moving member has a protrusion formed thereon.

16. The ink container according to claim 1, wherein a bottom surface of the ink container has a protrusion formed thereon, and the protrusion contacts the moving member.

17. The ink container according to claim 1, wherein a difference between an inclination angle of the top surface of the moving member to the vertical direction and an inclination angle of a virtual plane including the replenishing opening of the ink container to the vertical direction is less than or equal to 10 degrees.

18. The ink container according to claim 1, wherein the ink container is an ink container used in an inkjet printer that performs recording by ejecting ink.

19. An inkjet printer comprising:

an inkjet head configured to eject ink; and an ink container configured to store the ink inside thereof, wherein the ink container has a replenishing opening for refilling the inside thereof with ink, a pillar provided in the inside of the ink container and extending from a bottom surface of the ink container toward the replenishing opening, and a moving member disposed on the pillar in the inside of the ink container at a position below the replenishing opening in the vertical direction, wherein the moving member moves up and down the pillar with a level of a liquid surface of ink, stored inside, which moves up and down in the vertical direction.

20. The inkjet printer according to claim 19, wherein the ink container is connected to the inkjet head via a tube.

* * * * *